US008813990B1

(12) United States Patent
Berger

(10) Patent No.: US 8,813,990 B1
(45) Date of Patent: Aug. 26, 2014

(54) CONTAINER FOR TRANSPORTING HAZARDOUS MATERIAL

(71) Applicant: Metal Solutions Design & Fabrication, LLC, Dayton, KY (US)

(72) Inventor: M. David Berger, Cincinnati, OH (US)

(73) Assignee: Metal Solutions Design & Fabrication, LLC, Dayton, KY (US)

( * ) Notice: Subject to any disclaimer, the term of this patent is extended or adjusted under 35 U.S.C. 154(b) by 0 days.

(21) Appl. No.: 13/927,205

(22) Filed: Jun. 26, 2013

Related U.S. Application Data

(60) Provisional application No. 61/664,281, filed on Jun. 26, 2012.

(51) Int. Cl.
*B65D 51/16* (2006.01)
*B65D 85/00* (2006.01)
*B65D 90/54* (2006.01)

(52) U.S. Cl.
CPC ..... *B65D 85/70* (2013.01); *B65D 90/54* (2013.01)
USPC ..... 220/374; 220/1.5; 220/378; 220/668

(58) Field of Classification Search
CPC ..... B65D 85/70; B65D 90/54
USPC ..... 220/1.5, 378, 581, 668, 676, 681, 729, 220/374, 720; 217/56, 57
See application file for complete search history.

(56) References Cited

U.S. PATENT DOCUMENTS 3,968,895 A * 7/1976 Barnes et al. ..... 220/1.5
4,057,170 A * 11/1977 Dougherty ..... 220/323
5,098,364 A 3/1992 Schilling
5,110,005 A 5/1992 Schilling
5,393,117 A 2/1995 Beale
5,474,354 A 12/1995 Beale
5,624,049 A * 4/1997 Kovash et al. ..... 220/1.5
5,776,567 A 7/1998 Schilling et al.
6,079,934 A 6/2000 Beale
6,086,758 A 7/2000 Schilling et al.
6,115,772 A 9/2000 Crater
6,142,727 A 11/2000 Beale
6,306,293 B1 10/2001 Schilling et al.
6,554,997 B1 4/2003 Schilling et al.

(Continued)

OTHER PUBLICATIONS

MHF Services, Cargo Container Type A/7A, IP-2 and IP-3 DOT Certified, Product Information Flyer, One Page.

(Continued)

*Primary Examiner* — Robert J Hicks
*Assistant Examiner* — Kareen Rush
(74) *Attorney, Agent, or Firm* — Wood, Herron & Evans, LLP

(57) ABSTRACT

A cargo container and method for transporting hazardous material includes a housing, a frame, and a lid, or, alternatively a door. The frame and housing define an opening and an interior storage space for containing the hazardous material. The lid or door is operatively connected to the frame and covers the opening for inhibiting access to the interior storage space. A first gasket fluidly seals the lid or door for inhibiting hazardous material from moving from the interior storage space to an outer environment. Additionally, the cargo container may include a second gasket, a seal arrangement, and/or a tortuous path for deflecting airborne hazardous materials from the first gasket and further inhibiting hazardous material from moving from the interior storage space to the outer environment.

18 Claims, 12 Drawing Sheets

(56) References Cited

U.S. PATENT DOCUMENTS

| | | | | |
|---|---|---|---|---|
| 6,562,233 | B1 | 5/2003 | Schilling et al. | |
| 7,073,676 | B1 | 7/2006 | Town | |
| 7,146,914 | B2 * | 12/2006 | Morton et al. | 105/247 |
| 7,845,511 | B1 | 12/2010 | Strickland et al. | |
| 2007/0127852 | A1 | 6/2007 | Town et al. | |
| 2008/0031550 | A1 | 2/2008 | Town et al. | |

OTHER PUBLICATIONS

MHF Services, Shielded Multi-use Type-A Container and Transport System, Product Information Flyer, One Page.
MHF Services, Intermodal Container Type A/7A, IP-2 and IP-3 DOT Certified, Product Information Flyer, One Page.

* cited by examiner

CONTAINER FOR TRANSPORTING HAZARDOUS MATERIAL

CROSS-REFERENCE TO RELATED APPLICATION

This application claims the priority of Application Ser. No. 61/664,281 filed Jun. 26, 2012, the disclosure of which is hereby incorporated by reference herein.

TECHNICAL FIELD

This invention relates generally to a container, and more particularly, to a cargo container for transporting hazardous and radioactive materials and a modification to an existing cargo container for transporting such materials.

BACKGROUND

The transportation of hazardous and radioactive materials (collectively "hazardous material") often requires the use of cargo containers, trailers, railcars, and the like. To encourage efficient transportation with minimal ecological impact, the United States Department of Transportation regulates the transportation and storage of these materials by requiring minimal design safety criteria. See 49 CFR (incorporated by reference and collectively referred to herein as "DOT Design Criteria"). Similar regulations are enforced throughout much of the world, including IAEA International.

Cargo containers designed to transport hazardous material must be certified for such use. Certification requires meeting or surpassing testing requirements such as the free drop test and the stacking test as required by 173.410; 173.411; 173.465; and 173.466. During the free drop test, the cargo container is loaded to its design capacity and dropped from a specified height. Upon impact, the cargo container must maintain its structural integrity sufficiently to contain its testing contents. Powdered chalk is often used within the cargo container while testing as a benign indicator of the ability of the container to contain hazardous materials. In addition, the cargo container may be subjected to a stack test to verify its ability to contain cargo under significant compressive force for storage or final disposition.

Rigorous certification presents significant design hurdles and tradeoffs. For instance, the costs associated with designing and building cargo containers with such structural integrity are significant. After all, hazardous material cargo containers often include relatively complex design characteristics and increased quality control during manufacturing. Thus, a significant amount of time, money, and resources is typically expended to design and build the cargo container for transport of hazardous materials. However, many of the cargo container features are not certified for reuse after the initial transportation of hazardous material is complete. Thus, the cargo container is discarded and another is purchased requiring additional time, money, and resources.

Moreover, cargo containers certified for transporting hazardous materials often include complicated latches and sealing mechanisms to both seal and lock the containers. Unfortunately, complicated sealing mechanisms require additional expense and complicate their use as well as training and time to operate. Such designs often increase the likelihood of user error and elevated worker exposure to radiation while preparing the cargo container for transport of hazardous materials.

Additionally, shippers often transport a wide variety of goods, only some of which are hazardous materials. A shipping company's inventory of cargo containers typically includes a wide variety of container sizes and designs, many of which may not be rated or compatible for the transport of hazardous materials. The significant cost of known hazardous material cargo containers may prove prohibitive for a shipping company to purchase an inventory of such containers and it would be advantageous if existing cargo containers could be modified or retrofit to meet and pass the above described testing for certification to transport hazardous materials.

Thus, there is a need for a cargo container for use in transporting hazardous materials that addresses present challenges and characteristics such as those discussed above and others.

SUMMARY OF THE INVENTION

These and other objectives have been attained in various embodiments of this invention. In one embodiment, this invention is a cargo container for transporting hazardous materials having a housing connected to a frame. The frame and the housing contribute to define an opening and an interior storage space with the interior storage space being accessible through the opening. A lid may be operatively connected to the frame with the lid covering the opening for inhibiting access to the interior storage space through the opening. A flange may be operatively connected to the frame and positioned adjacent to the lid covering the opening and generally surrounding the opening. A first gasket may be positioned on the flange to generally surround the opening. The first gasket may be sandwiched between the flange and the lid for fluidly sealing the lid to the flange to inhibit hazardous materials from moving from the interior storage space to an outer environment. As such, a tortuous path is at least partially defined by the housing and extends from the interior storage space to the first gasket. One aspect of the tortuous path being a groove generally surrounding the opening. Another aspect of this invention may be that the housing is configured to deflect at least a portion of air borne hazardous materials away from the first gasket such that the tortuous path further inhibits passage of hazardous material from the interior storage space to the outer environment.

Other embodiments of this invention may include an inner panel of the lid defining an air bladder such that the inner panel and air bladder further define the groove. A second gasket may be attached to the flange with the first and second gaskets sandwiched together and offset from each other for higher friction and contact between the gaskets. The cargo container may further include a seal arrangement positioned adjacent to the interior storage space and covering the opening for further deflection of air borne hazardous materials away from the first gasket. The invention may further include a sheet material having an edge portion and an extension member connected to the edge portion of the sheet material configured to rigidly extend the edge portion of sheet material such that the extension member removably inserts into the groove for supporting the seal arrangement across the opening.

A further embodiment of this invention is a cargo container for transporting hazardous materials having a frame and a housing, the frame and the housing defining an interior volume, the interior volume being accessible through an opening. A door may be connected to the frame and adjacent to the opening such that the door is movable between an open position and a closed position. A locking mechanism may be connected to at least one of either the door or the frame with the locking mechanism sealing the door to the frame. A seal arrangement closes an opening of the cargo container and is positioned within the interior volume of the container to define an interior storage volume which is accessible via the closable opening. A first seal may be between the frame and the door and surround the entirety of the opening. A second seal may seal the closable access opening of the seal arrangement with the first seal sufficiently sealing the interior to inhibit the escape of hazardous materials therethrough. The seal arrangement may include a number of flaps at the opening configured to close the opening.

Other embodiments of this invention extend to a method of containing hazardous materials within a cargo container by creating a first seal between the door to the frame in a closed position in order to cover the opening and sufficiently seal the interior volume from an outer environment. The method may also include creating a second seal with a seal arrangement between the door and the interior storage space in order to further cover the opening The method may further include deflecting airborne hazardous materials with the seal arrangement from the first seal for inhibiting passage of hazardous material from the interior volume to the outer environment.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

DETAILED DESCRIPTION

Figure 1:
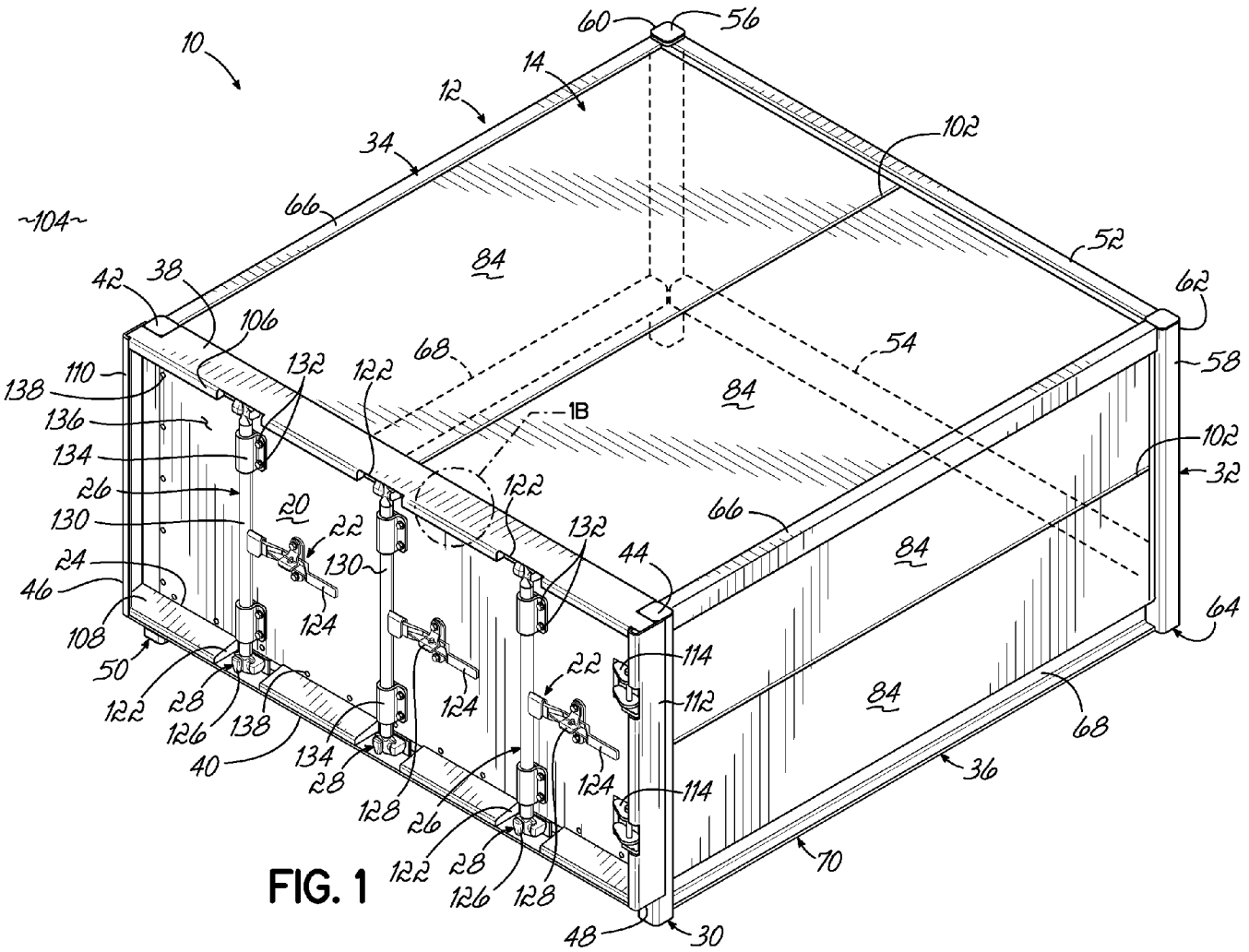
FIG. 1 is a perspective view of one embodiment of a cargo container for transporting hazardous materials according to this invention.

With reference to FIG. 1, an embodiment of a cargo container 10 for transporting hazardous materials includes a frame 12 and a housing 14. The housing 14 is affixed to the frame 12 to define an interior volume 16 (see FIG. 1A) in which the hazardous materials are stored for transport. The frame 12 affixed to housing 14 also defines an opening 18 (see FIG. 1A) permitting access to the interior volume 16 of the cargo container 10. Moreover, the frame 12 and housing 14 are structurally rigid and rigidly affixed as a rectangular cuboid with the interior volume 16 being similarly fixed. However, any rigid shape may be used such that the dimensions of the housing 14, frame 12, and interior volume 16 may vary according to the principles of the invention discussed herein.

Figure 1A:
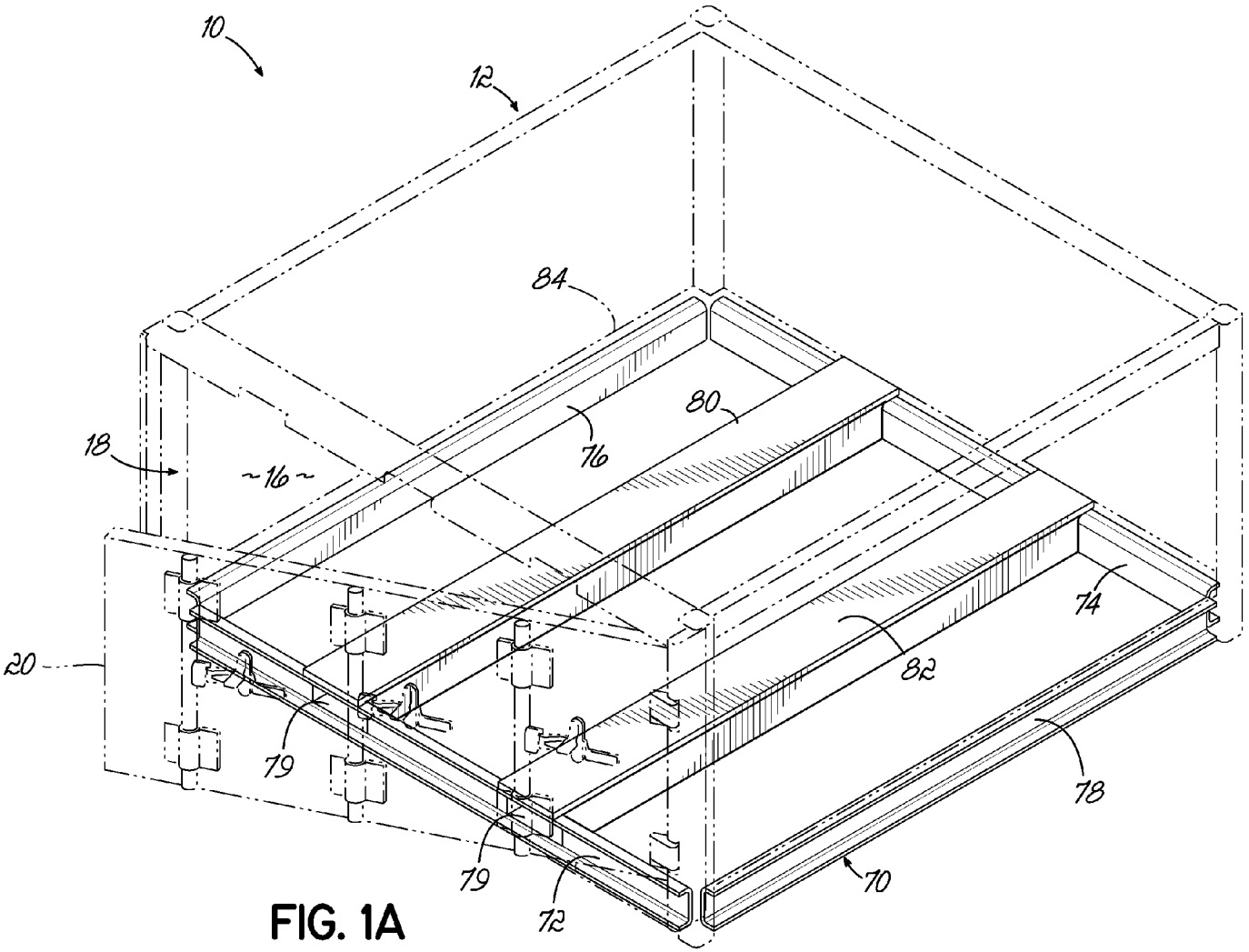
FIG. 1A is a view similar to FIG. 1 with the door in an open configuration.

A door 20 is connected to the frame 12 and thereby movable between an open position shown in phantom lines in FIG. 1A and a closed position as shown in FIG. 1. The door 20 is swingably connected to the frame 12 such that in the closed position the door 20 seals against the frame 12 to cover the opening 18. A number of discrete locking mechanisms 22 are operably connected to the container 10 to maintain the door 20 in the closed position and maintain a seal 24 between the door 20 and the frame 12. As shown in this embodiment, a first locking mechanism portion 26 of each locking mechanism 22 is connected to the door 20 and a second locking mechanism portion 28 is connected to the frame 12. Thereby, in the closed position, the first portion of the locking mechanism 26 interlocks with the second portion of the locking mechanism 28 to seal the door 20 to the frame 12.

Figure 1B:
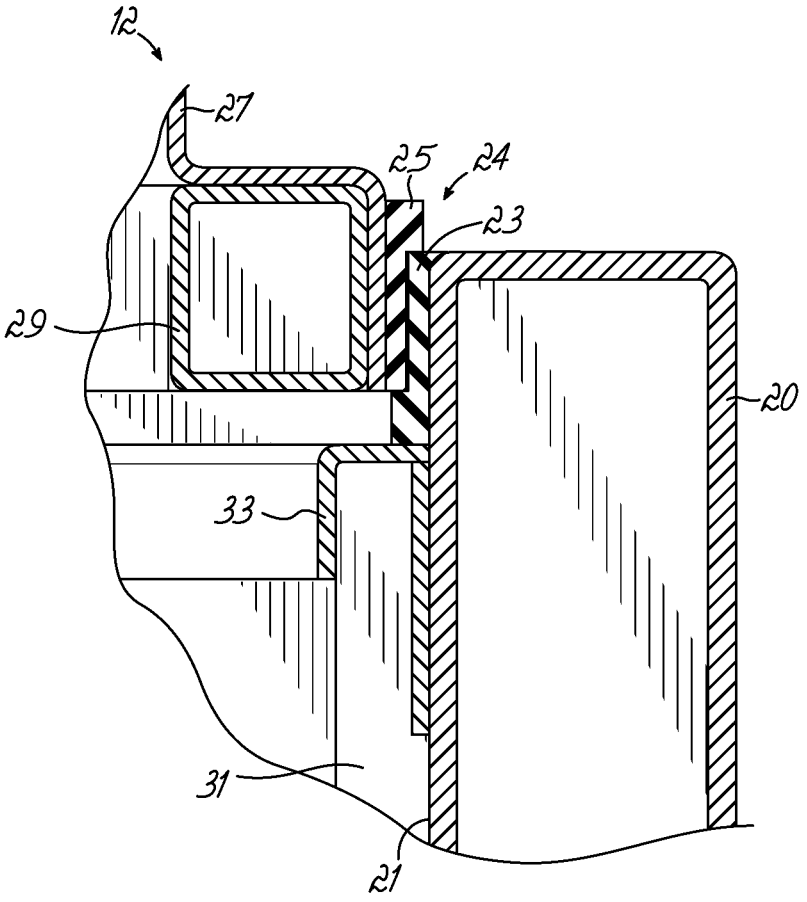
FIG. 1B is an enlarged cross-sectional view of area 1B of FIG. 1 showing a seal arrangement between the door and cargo container.

Referring to FIG. 1B, a seal 24 is formed between the door 20 and the frame 12. An inner surface 21 of the door 20 includes a door gasket 23 and the frame 12 includes a box gasket 25 mounted on a shaped lip 27 of the frame 12. The lip 27 is shaped to receive a gasket reinforcing tube 29 as shown in FIG. 1B. Each gasket 23, 25 surrounds at least a portion of the opening 18 and is held in position by pressure sensitive adhesive (PSA). A sheet of oriented strand board (OSB) 31 is mounted on the inner surface 21 of the door 20 by an OSB clip 33. In the closed position, the locking mechanism 22 maintains sufficient compression of the door gasket 23 to the box gasket 25 to maintain the seal 24. While this embodiment is configured to create the seal 24 with two gaskets 23, 25, it will be appreciated that other gasket configurations may be used in other embodiments within this invention.

As shown in FIG. 1, the frame 12 is a rigid framework configured to withstand testing per the DOT Design Criteria. The frame 12 includes a front frame 30, a back frame 32, and a pair of lateral frames 34, 36. The front frame 30 forms a rectangular frame having a front top frame 38, a front bottom frame 40, and a pair of front corner frames 42, 44. As such, the front top frame 38 and front bottom frame 40 are positioned horizontal and parallel to each other having generally the same length. In addition, the pair of front corner frames 42, 44 are vertical and parallel to each other having generally the same length. The front corner frame 42 is attached at a first front end portion 46 of the front top and bottom frames 38, 40 and the front corner frame 44 is attached at a second front end portion 48 of the front top and bottom frames 38, 40. The pair of front corner frames 42, 44 may be attached at generally right angles to the front top frame 38 and the front bottom frame 40 thereby forming the rigid, rectangular front frame 30. More preferably, the front bottom frame 40 is attached to the front corner frames 42, 44 such that a front base portion 50 of the pair of front corner frames 42, 44 extends vertically below the front bottom frame 40. According to this embodiment, the front top frame 38, the front bottom frame 40, and the front corner frames 42, 44 are attached by welds forming the front frame 30 as a weldment.

As shown in FIG. 1, the front top frame 38, the front bottom frame 40, and the pair of front corner frames 42, 44 are advantageously hollow box beams to provide sufficient rigidity to maintain the integrity of the rectangular shape with minimal weight. Typically, the frame members are made of metal, including steel, aluminum and other metals as is appropriate and known in the industry. However, it will be appreciated that the front top frame 38, the front bottom frame 40, and the front corner frames 42, 44 may be any combination of members or materials, metal and non-metal, sufficiently connected or formed of a unitary piece to withstand testing per the DOT Design Criteria.

The back frame 32 forms a rectangular frame having a back top frame 52, a back bottom frame 54, and a pair of back corner frames 56, 58. As such, the back top frame 52 and back bottom frame 54 are positioned horizontal and parallel to each other having generally the same length. In addition, the pair of back corner frames 56, 58 are vertical and parallel to each other having generally the same length. The back corner frame 56 is attached at a first back end portion 60 of the back top and bottom frames 52, 54 and the back corner frame 58 is attached at a second back end portion 62 of the back top and bottom frames 52, 54. Preferably, the pair back corner frames 56, 58 are attached at generally right angles to the back top frame 52 and the back bottom frame 54 thereby forming the rigid, rectangular back frame 32. More preferably, the back bottom frame 54 is attached to the back corner frames 56, 58 such that a back base portion 64 of the pair of back corner frames 56, 58 extends vertically below the back bottom frame 54. According to this embodiment, the back top frame 52, the back bottom frame 54, and the pair of back corner frames 56, 58 are attached by welds forming the back frame 32 as a weldment.

As shown in FIG. 1, the back top frame 52, the back bottom frame 54, and the pair of back corner frames 56, 58 are advantageously hollow box beams to provide sufficient rigidity to maintain the integrity of the rectangular shape with minimal weight. Typically, the frame members are made of metal, including steel, aluminum and other metals as is appropriate and known in the industry. However, it will be appreciated that the back top frame 52, back bottom frame 54, and the pair of back corner frames 56, 58 may be any combination of members or materials, metal and non-metal, sufficiently connected or formed of a unitary piece to withstand testing per the DOT Design Criteria.

To form the frame 12, preferably as the rectangular cuboid, a pair of lateral frames 34, 36 are connected to the front frame 30 and the back frame 32. Each of the lateral frames 34, 36 includes a top lateral frames 66 and a bottom lateral frames 68. Each of the lateral frames 34, 36 are positioned horizontally and attached between the front frame 30 and back frame 32 to form the eight corners of the rectangular cuboid. Preferably, each of the lateral frames 34, 36 are welded to the front frame 30 and back frame 32.

To provide further structural strength to the cargo container 10 and facilitate movement of the cargo container 10 by a fork lift, the frame 12 also includes a lower frame 70 as shown in FIG. 1A. The lower frame 70 includes a lower front member 72, a lower back member 74, and a pair of lower lateral members 76, 78 positioned below and affixed respectively to the front bottom frame 40, the back bottom frame 54, and the lateral bottom frames 68. Moreover, the lower frame 70 is affixed to and extends between the front and back base portions 50, 64 of the front and back corner frames 42, 44, 56, 58. While it will be appreciated that a variety of frame members may be used, the lower front member 72, lower back member 74, and lower lateral members 76, 78 are preferably channel beams as shown in FIG. 1A.

Moreover, the front bottom frame 40 and back bottom frame 54 include a pair of aligned holes 79. The pair of holes 79 are adapted to the forks of the fork lift for lifting the cargo container 10 such that the pair of aligned holes 79 are centrally located and extend through each of the front and back bottom frames 40, 54. More preferably, a pair of bottom support members 80, 82 are horizontally positioned to extend between the lower front member 72 and the lower back member 74. The pair of bottom support members 80, 82 are centrally aligned with the pair of aligned holes 79 between the front bottom frame 40 and the back bottom frame 54 such that standard forklift forks (not shown) may be inserted into the pair of bottom support members 80, 82. Thereby, the forklift may lift the cargo container 10 such that the weight of the cargo container is evenly distributed to the forks of the forklift.

In addition, the cargo container 10 preferably includes a plurality of stiffener members (not shown) that add structural rigidity to the frame 12 and furthermore support the housing 14 attached to the frame 12. More specifically, the plurality of stiffener members (not shown) extend between the front frame 30, the back frame 32, and each of the lateral frames 34, 36 and are accordingly affixed to the frame 12. According to this embodiment, the stiffener members (not shown) are within the housing 14; however, it will be appreciated that the stiffener members (not shown) may be arranged relative to the housing 14 in a variety of configurations so long as the stiffener members (not shown) are configured to stiffen the frame 12 and support the housing 14. Vertical stiffeners are often used to a carry stacked load.

With reference to FIG. 1, the housing 14 is affixed to the frame 12 and the plurality of stiffener members (not shown) to form a rectangular cuboid weldment having the opening 18 to the interior volume 16. The housing 14 includes a plurality of panels 84. The plurality of panels 84 surround at least a portion of the interior volume 16 and are affixed to the frame 12. Moreover, any number of panels 84 may be so used and attached side-by-side. For instance, a pair of panels 84 extends from the front top frame 38 to the back top frame 52 and is joined by a central weld 102, preferably a flare weld, which effectively seals these adjacent panels together. It will be appreciated, with exception to the carbon filter (not shown) and the opening 18, the rectangular cuboid weldment serves to define the interior volume 16 and seal the interior volume 16 from an outer environment 104.

Moreover, the housing 14 includes a plurality of protective members 106, 108, 110, 112 that are connected to the front frame 30 and extend out beyond the periphery of the door 20. The plurality of protective members 106, 108, 110, 112 include a top protective member 106 attached to the front top frame 38, a bottom protective member 108 attached to the front bottom frame 40, and a pair of corner protective members 110, 112 attached to the pair of front corner frames 42, 44. The plurality of protective members 106, 108, 110, 112 may also be attached together and welded to the front frame 30. As shown, the plurality of protective members 106, 108, 110, 112 project beyond the door 20 and locking mechanism 22 to protect the cargo container 10 from potentially harmful impacts during transport. It will be appreciated, however, that the protective members 106, 108, 110, 112 may be separate as shown FIG. 1 or unitary with the front frame 30.

The door 20 is surrounded by the plurality of protective members 106, 108, no, 112 and removably sealed against the frame 12. In this embodiment, the door 20 is connected to the frame 12 at the front corner frame 44 by a pair of hinges 114. Each hinge 114 is connected between the door 20 and the frame 12 such that the door 20 is swingably connected to the frame 12 to operatively close the door 20 (see FIG. 1) and opens the door 20 (See FIG. 1A). To operatively close and open the door 20, the top and bottom protective members 106, 108 include a plurality of slots 122. The plurality of slots 122 are configured such that at least a portion of the locking mechanism 22 passes through at least a portion of the plurality of slots 122 to open and close the door 20 from against the frame 12.

As shown in FIG. 1, the locking mechanism 22 seals the door 20 to the frame 12. While many types of locking mechanisms 22 may be so used, this embodiment of locking mechanism 22 includes a handle 124, a retainer 126, and a catch 128. The handle 124 is a cam handle further including a rotatable member 130 such that rotating the handle 124 also rotates the rotatable member 130 into the retainer 126 to seal the door 20. In addition, the catch 128 is affixed to the door 20 adjacent to the handle 124 such that the handle 124 may be captured by the catch 128. A padlock (not shown), or similar lock, may be used in conjunction with the catch 128 such that the door 20 is lockable while closed. Moreover, a plurality of capscrews 132 and a plurality of brackets 134 may be used to mount the locking mechanism 22 to the door 20.

The door 20 includes both an inner door panel (not shown) and an outer door panel 136. According to this embodiment, the inner door panel (not shown) is affixed to the outer door panel 136 by a plurality of plug welds 138. Moreover, the door 20 may also include a plurality of door stiffeners (not shown). Preferably, the door stiffeners (not shown) are affixed between the inner door panel (not shown) and the outer door panel 136. More preferably, the door stiffeners (not shown) are configured to stiffen the door 20 where each handle 124 is connected to the door 20 to add further structural rigidity and maintain the integrity of the first seal 24.

Figure 2:
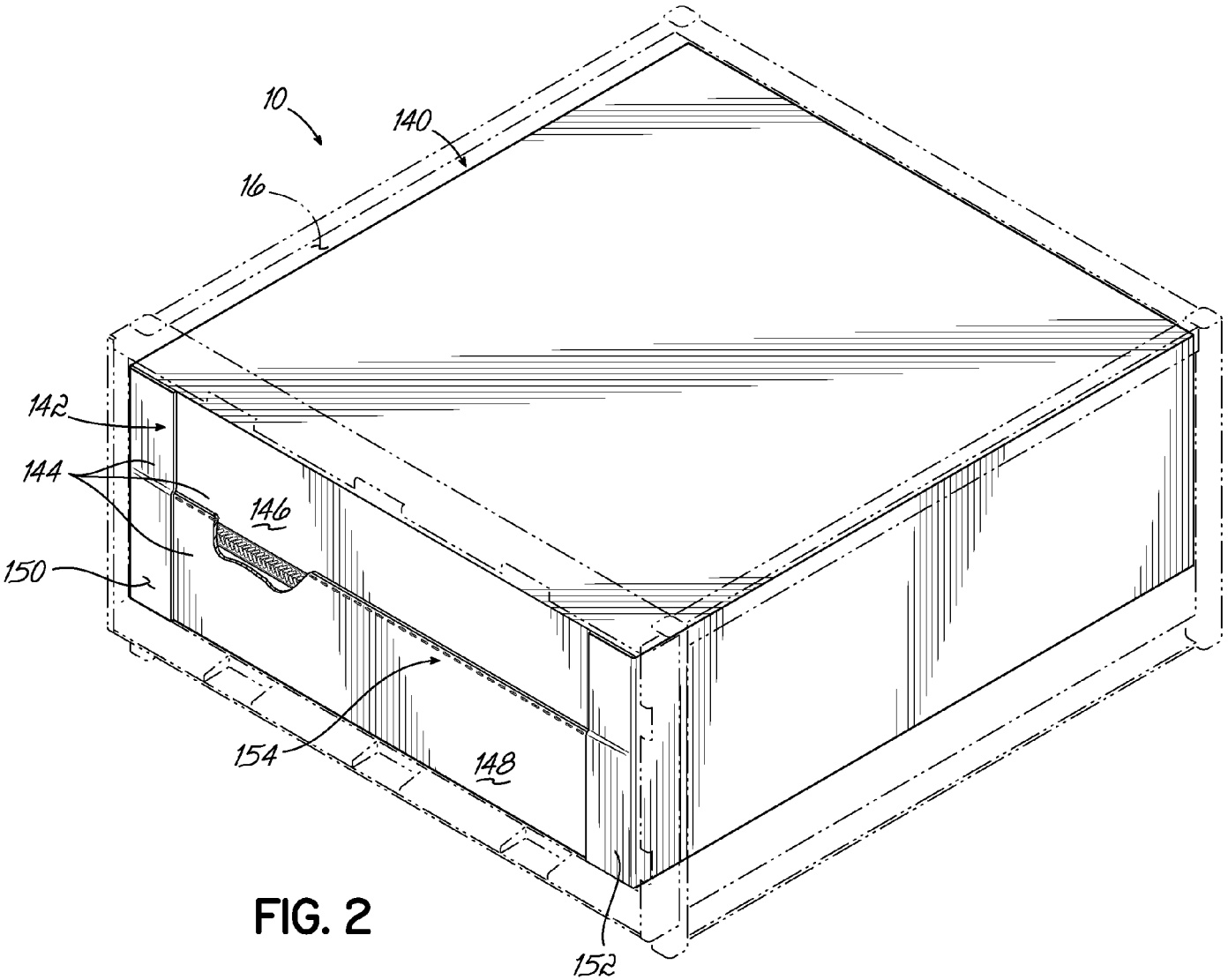
FIG. 2 is a perspective view of one embodiment of a seal arrangement with the remaining portion of the cargo container from FIG. 1 shown by phantom lines for environment.
Figure 3:
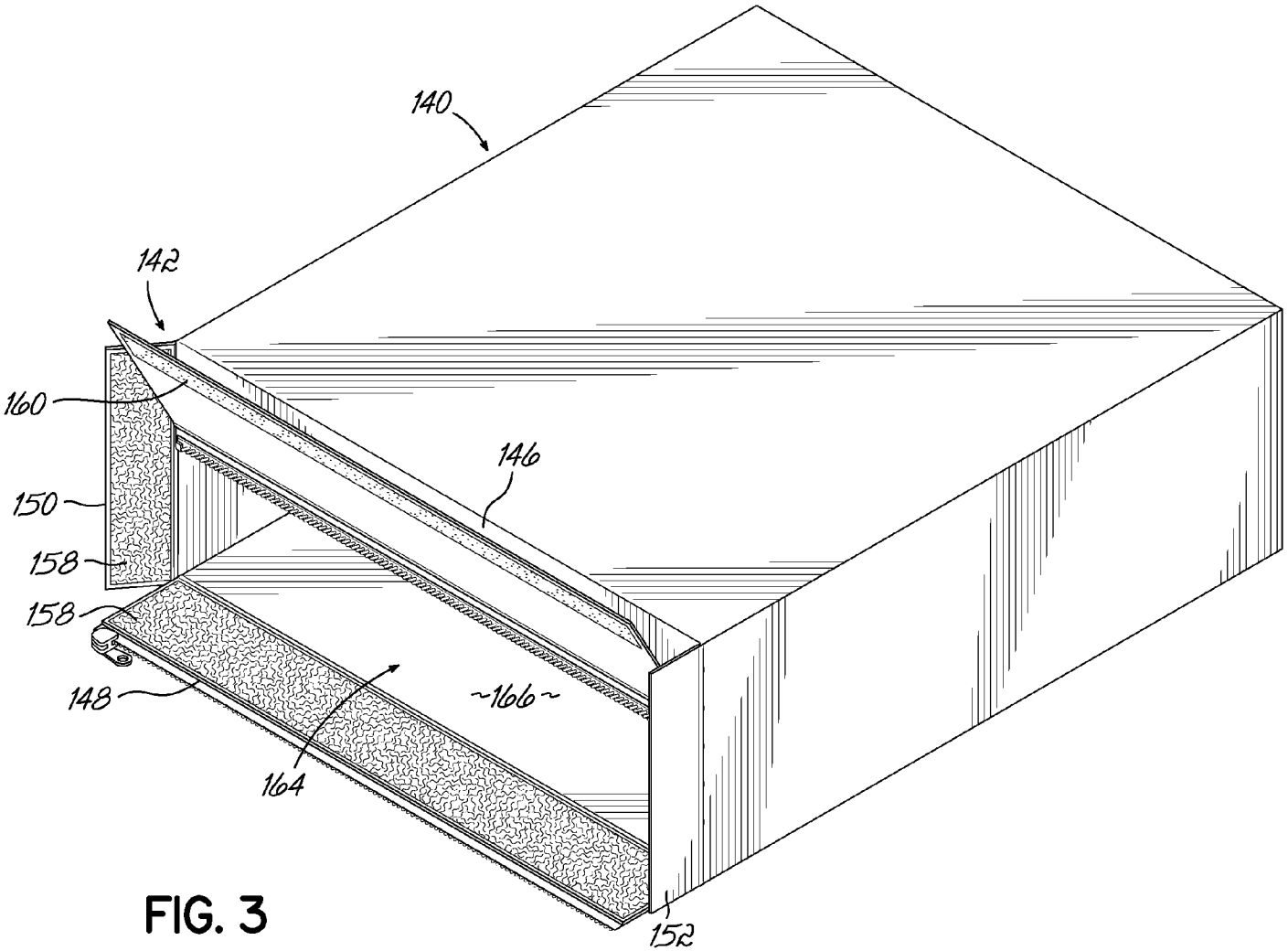
FIG. 3 is a perspective view of the seal arrangement of FIG. 2 in an open position.
Figure 4:
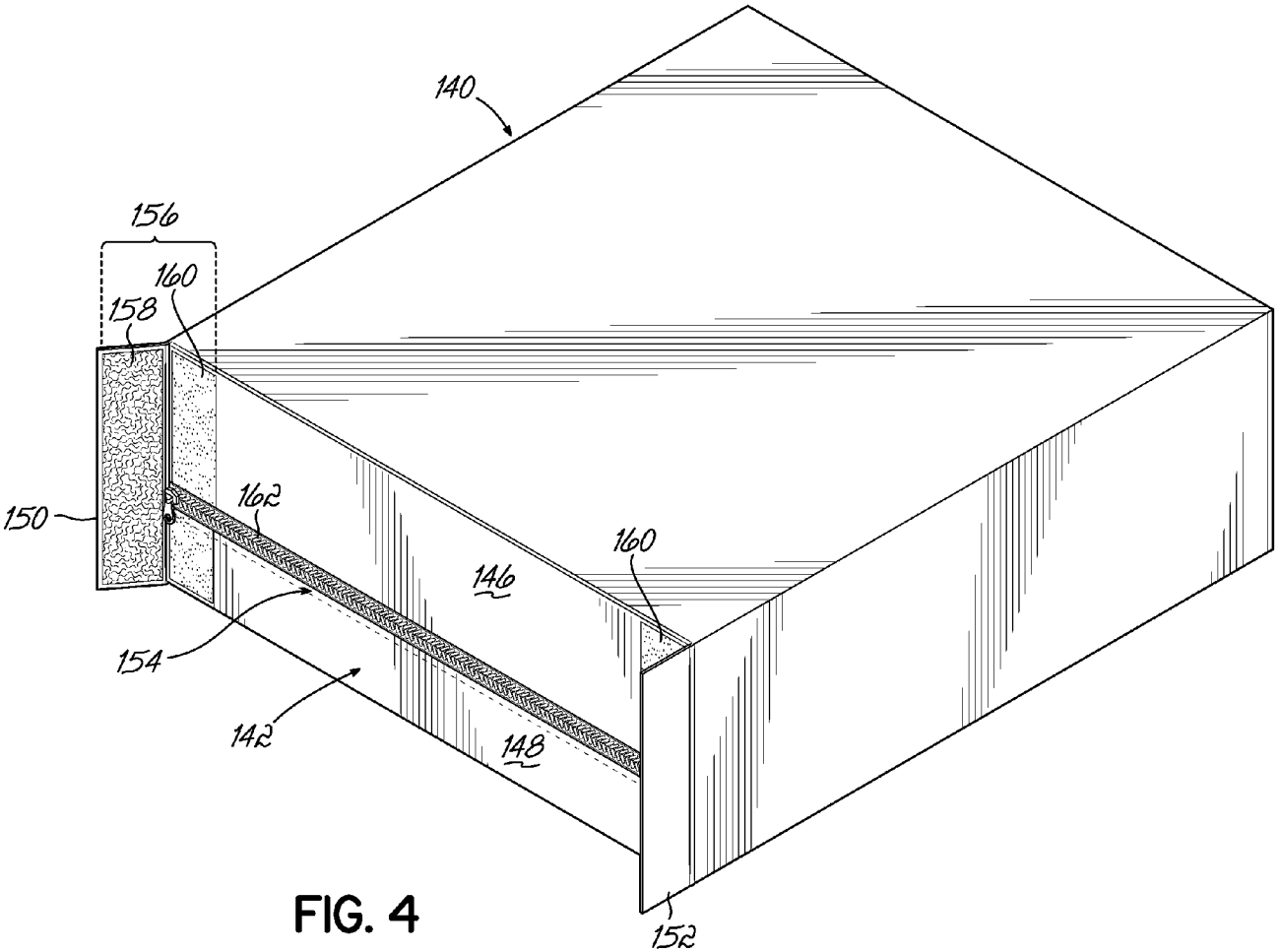
FIG. 4 is a perspective view of another embodiment of a seal arrangement in a partially closed position.

According to one aspect of this invention as shown in FIG. 2, the interior volume 16 of the cargo container 10 includes a seal arrangement 140. The seal arrangement 140 is openable and closable at a front portion 142 of the seal arrangement 140 via a plurality of flaps 144, which further include a top flap 146, a bottom flap 148, and first and second side flaps 150, 152. Each of the flaps 144 are either bent outward to open the front portion 142 or bent inward to close the front portion 142. Moreover, the plurality of flaps 144 fold over each other to close the front portion 142 of the seal arrangement 140, thereby creating a second seal 154. FIGS. 2-3, also show the plurality of flaps 144 sealed together using a plurality of hook and loop fasteners 156 such that when each of the flaps 144 are bent inward, the plurality of flaps 144 overlap joining a hook tape 158 to a loop tape 160, each of the flaps 144 including at least one of either the hook tape 158 and the loop tape 160. In addition, one of the flaps 144 is shown partially cutaway in FIG. 2 in order to show a zipper 162 for further sealing capability. If the zipper 162 is included in the arrangement, it may be offset from the free edge of the flap by about 2 inches so as to protect and conceal the zipper after the flaps are closed. As shown in FIG. 3, bending the plurality of flaps 144 outward reveals a seal arrangement opening 164. The opening 164 provides access to an interior storage volume 166, which is defined by the seal arrangement 140. In an alternative embodiment shown in FIG. 4, the zipper 162 is attached to the plurality of flaps 144, but without the use of the adjoining hook and loop fastener 156 on at least some of the flaps 144. However, it will be appreciated that any structure or mechanism for sealing the flaps 144 together may be similarly used. Moreover, other overlapping arrangements for the various flaps may be employed within the scope of this invention.

Figure 5:
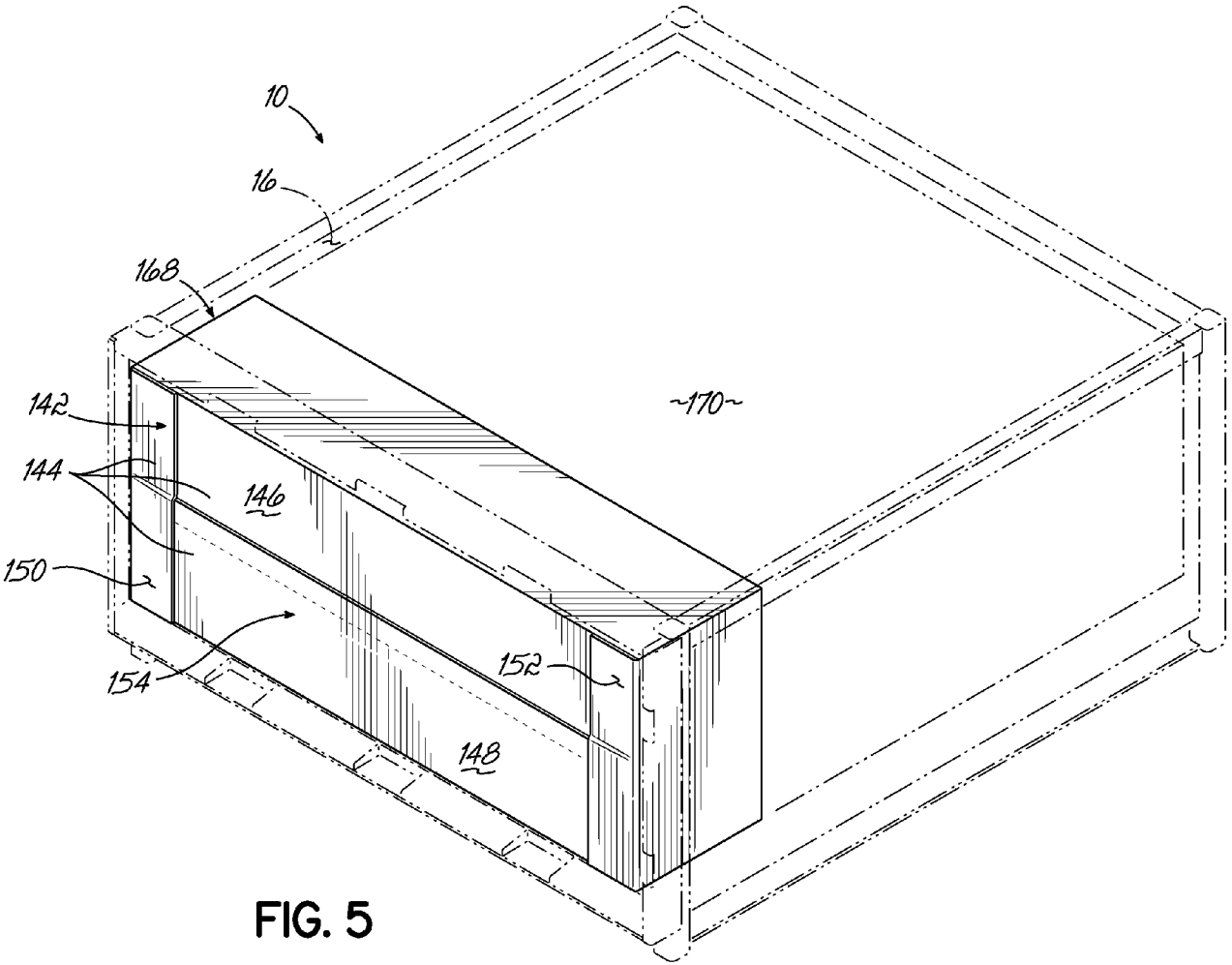
FIG. 5 is a perspective view of a second embodiment of the seal arrangement with the remaining portion of the cargo container from FIG. 1 shown by phantom lines for environment.
Figure 7:
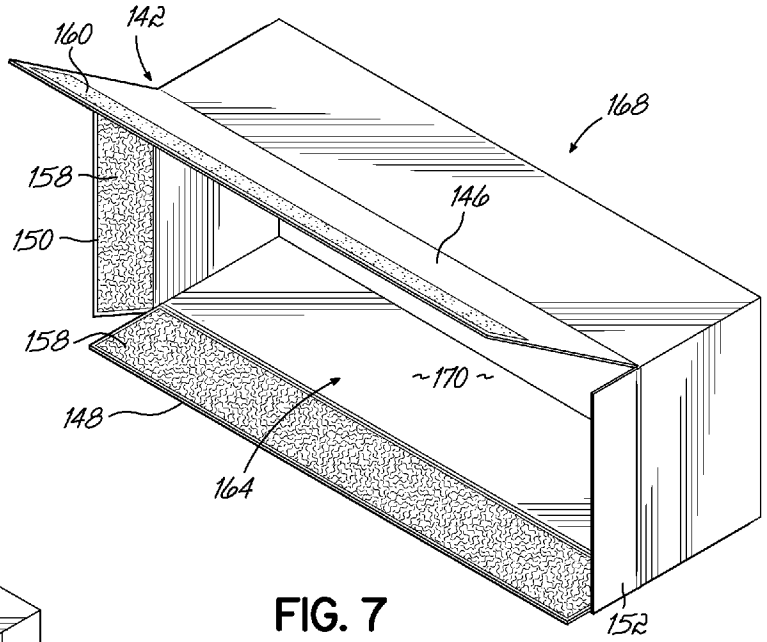
FIG. 7 is a perspective view of the seal arrangement of FIG. 5 in an open position.
Figure 6:
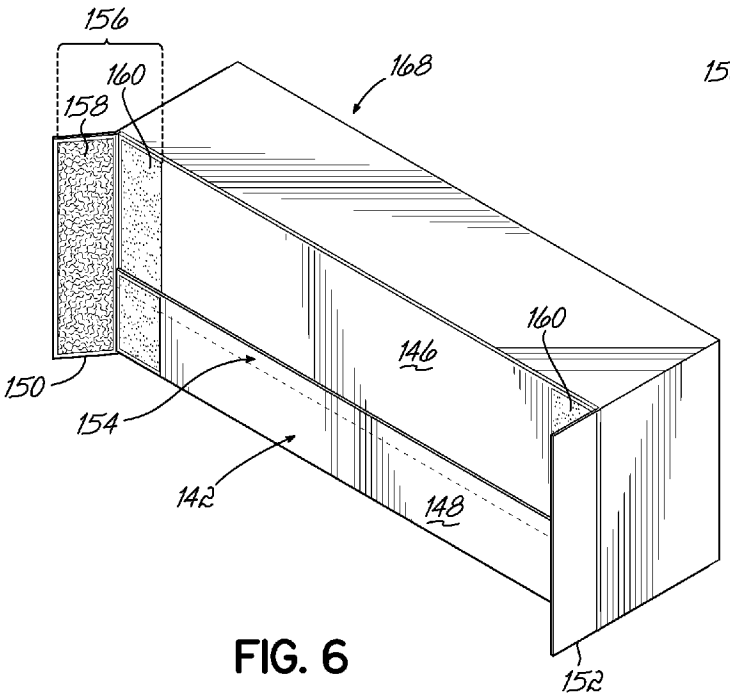
FIG. 6 is a perspective view of the seal arrangement of FIG. 5 in a partially closed position.

FIGS. 5-7 show another embodiment of the seal arrangement 168. In this embodiment, the seal arrangement 168 is defined by the front portion 142 of seal arrangement 140, which includes the plurality of flaps 144. The top flap 146, bottom flap 148, first side flap 150, and second side flap 152 each are affixed to the housing 14 from within the interior volume 16 and may be formed from one piece of material or individual pieces of material. Moreover, the seal arrangement 168 includes the seal arrangement opening 164. In various embodiments, the material for the seal arrangement 140, 168 may be a tarp material. A tarpaulin, colloquially tarp, is a large sheet of strong, flexible, water-resistant or waterproof material, often cloth such as canvas or polyester coated with urethane, or made of plastics such as polyethylene. Many tarpaulins are made from woven polypropylene; this material is so associated with tarpaulins that it has become colloquially known in some quarters as polytarp. Polyethylene tarps, a.k.a. poly tarps, are made with polyethylene, nylon tarp threading inside the material with a rope reinforcement around the perimeter of the poly tarp material. Polyethylene (PE) resins are milky white, translucent substances derived from ethylene (CH29CH2). Polyethylene is made in low- and high-density forms. Low-density polyethylene (LDPE) has a density ranging from 0.91 to 0.93 g/cm3 (0.60 to 0.61 oz/cu in).

Other materials for the seal arrangement members include vinyl polyester, vinyl coated, polyethylene, high density polyethylene weaved into tarp fabric and laminated on both sides for long lasting durability, and canvas. Canvas is commonly known as a closely woven, plain weave fabric made of natural or synthetic fibers. However, other materials with same, similar and/or different properties as those materials noted here may be used within the scope of this invention.

In any embodiment of the seal arrangement 140, 168 as shown in FIGS. 2-7, the hook and loop fasteners 156 are used to provide shear strength in case the cargo container 10 undergoes a significant impact. Also, the zipper 162 provides additional force to pull at least a couple of the plurality of flaps 144 together to help ensure a properly sealed closure. Moreover, the seal arrangement 140, 168 may be surrounded by a liner (not shown) affixed to the housing 14 within the interior volume 16. The liner (not shown) may include a plurality of liner panels (not shown) such that each liner panel is sized and attached to the plurality of panels 84 and the inner door panel (not shown). While each of the liner panels (not shown) may be made using any suitable material to line the interior volume 16, the plurality of liner panels (not shown) are preferably oriented strand board and positioned between the seal arrangement 140, 168 and the housing 14. In the case of the liner (not shown) being used in conjunction with seal arrangement 168, the interior storage volume 170 is defined by both seal arrangement 168 and the liner (not shown).

Furthermore, the housing 14 shown in FIG. 1 and by hidden line in FIG. 2 and FIG. 5 may also include a carbon filter (not shown). The carbon filter (not shown) is operatively connected with the interior storage volume 166, 170, and the outer environment 104 that surrounds the cargo container 10 such that air may pass through the carbon filter (not shown) in either direction. However, the carbon filter (not shown), while permitting the transfer of air, prevents radiation from hazardous materials within cargo container 10 from leaking to the outer environment 104.

The seal arrangement 140 covers substantially the entire interior volume 16 while the seal arrangement 168 is provided in the interior volume 16 adjacent to the opening 18 and door 20. In any embodiment according to this invention, the seal arrangement inhibits and/or prevents the escape of hazardous materials from the interior volume 16 both during normal transport and operation as well as in the event of damage to the frame 12 or housing 14 of the cargo container.

FIGS. 6-7 show sequential closing/opening operations for either of the seal arrangements 140, 168 according to aspects of this invention. For closure of the opening after hazardous materials are inserted into the housing 14 through the opening 18, initially, top flap 146 is folded downwardly to a generally parallel orientation relative to and partially blocking the opening 18. Next, bottom flap 148 is folded upwardly and onto the distal portion of top flap 146 into at least a partially overlapping arrangement as shown in FIG. 6. In such an overlapping arrangement, the hook and loop portions 158, 160 of the respective flaps 146, 148 form a sealed seam between the flaps. With the top and bottom flaps 146, 148 overlapping as shown in FIG. 6, the first and second side flaps 150, 152 are each folded inwardly and onto the adjacent, lateral end portions of the top and bottom flaps 146, 148. The mating hook and loop portions 158, 160 for the side flaps 150, 152 and overlapped lateral end portions of the top and bottom flaps 146, 148 form additional sealed seams at the respective lateral sides of the opening 18. As such, the opening 18 is effectively and efficiently sealed to inhibit and prevent the escape of hazardous materials from the cargo container in a convenient manner for selective opening and re-closing of the opening 18 as needed for the storage and/or transport of the hazardous or other materials within the interior volume 16 of the cargo container. A reverse order of steps manipulating the flaps 146, 148 150, 152 may be utilized to open the opening 18 as is readily understood by one of skill in the art.

Figure 8:
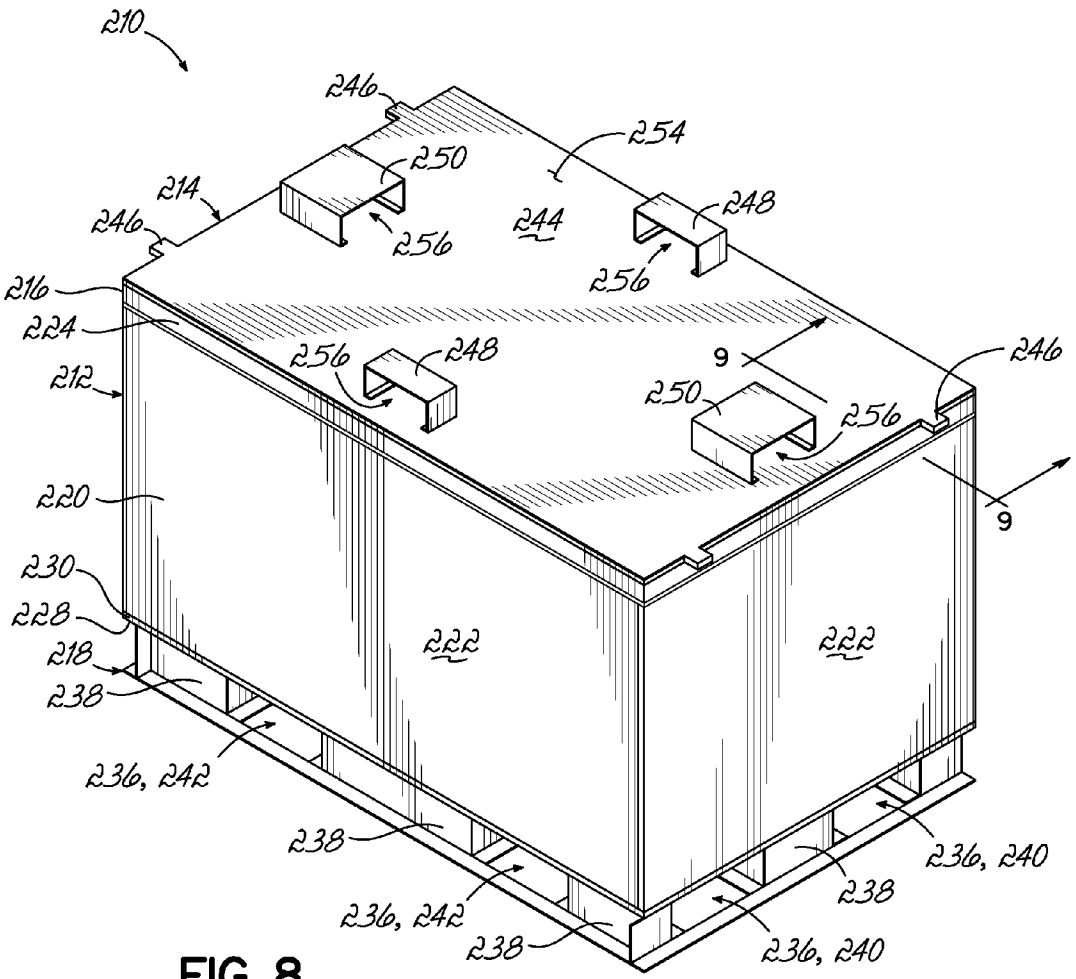
FIG. 8 is a perspective view of a second embodiment of a cargo container for transporting hazardous materials according to this invention.
Figure 9:
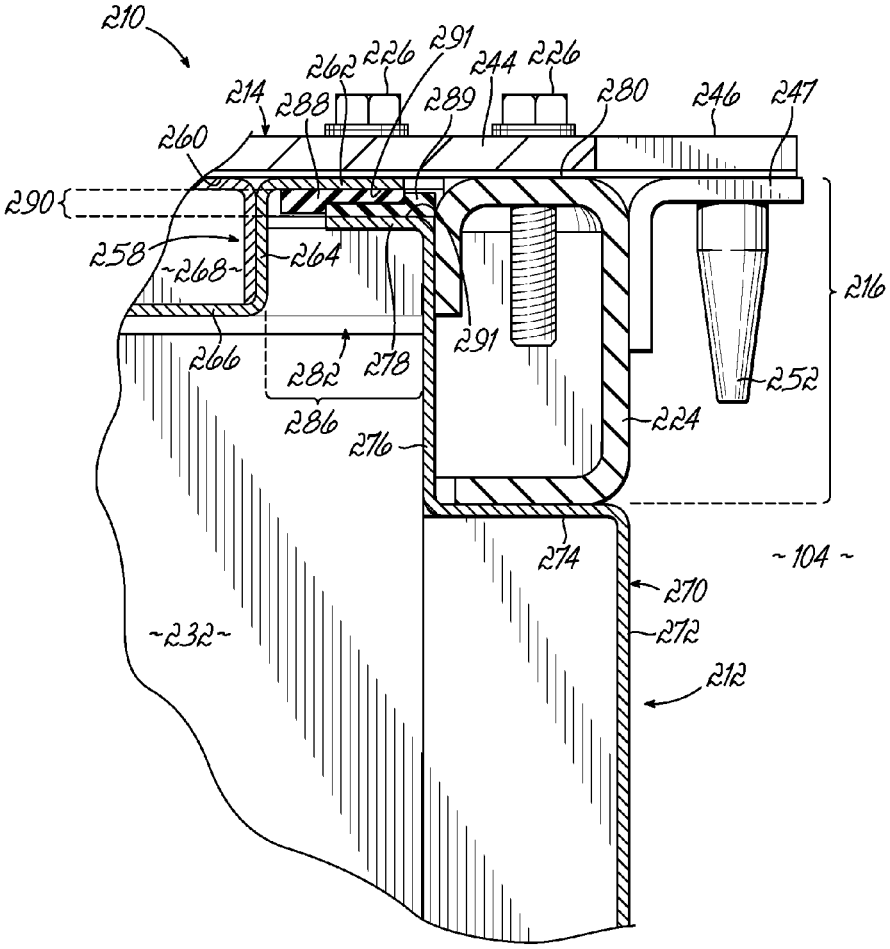
FIG. 9 is a cross-sectional view of FIG. 8 taken at section 9-9 to illustrate the seal arrangement of the second embodiment of the container.

With reference to FIGS. 8-9, a second embodiment of a cargo container 210 includes a housing 212, a lid 214 affixed to an upper portion of the housing 216, and a lift support 218 connected to a lower portion of the housing 220. The housing 212 includes a plurality of panels 222 defining vertical sidewalls of a rectangular cuboid. In addition, a frame member 224 is at the periphery of the upper portion of the housing 216. Thereby, the lid 214 may be removably affixed to the frame member 224 by a plurality of capscrews 226 (see FIG. 9). As with the previous embodiment, this embodiment is configured to be sufficiently rigid to withstand testing per the DOT Design Criteria.

Furthermore, each of the panels 222 includes a bottom portion 228 and the lower portion of the housing 220 is attached to a bottom panel 230. The bottom panel 230 is adjacent and connected to the bottom portion 228 of the plurality of panels 222. As such, the bottom panel 230, the plurality of panels 222, and the lid 214 define an interior storage space 232 (see FIG. 9).

As shown in FIG. 8, the lift support 218 is connected to the bottom panel 230. The lift support 218 includes a plurality of lift pockets 236 so that the cargo container 210 may be carried and positioned by a forklift or similar transport device. The lift support 218 includes a plurality of beams 238 that is positioned horizontally and connected to the bottom panel 230 below the outer periphery of the bottom panel 230. Thereby, the plurality of beams 238 is configured to support the weight of the cargo container 210. Moreover, each of the lift pockets 236 extend horizontally and through the plurality of beams 238. A first pair of lift pockets 24*o* is centrally located on at least one beam to accommodate a 24" pair of forks (not shown) while a second pair of lift pockets 242 is centrally located on at least one other beam to accommodate a 36" pair of forks (not shown).

Furthermore, the lid 214 includes a top panel 244, a first and second plurality of guide flanges 246, 247, a pair of first lid lifts 248, and a pair of second lid lifts 250 as shown in both FIG. 8 and FIG. 9. The first and second pluralities of guide flanges 246, 247 are configured to aid in the alignment of the lid 214 with the housing 212. More specifically, the first plurality of guide flanges 246 are extending out from the top panel 244 and formed from the same structural component. Additionally, the second plurality of guide flanges 247 are attached to the upper portion of the housing 216 and extend outward to generally align with the first portion of the plurality of guide flanges 246. A plurality of guide pins 252 (see FIG. 9) are attached to the lid 214 at the first plurality of guide flanges 246 and extend generally perpendicularly downward relative to the lid 214. While assembling the lid 214 to the housing 212, each of the guide pins 252 will insert into an alignment aperture (not shown) within the respective guide flanges 247 to ensure proper alignment of the lid 214 to the housing 212.

Each of the pair of first and second lid lifts 248, 250 are affixed to a top face 254 of the top panel 244 and positioned near the periphery of the top panel 244. Moreover, each pair of the first and second lifts 248, 250 is configured such that a fork lift, or similar lifting device, may lift the lid 214 from the housing 212. More specifically, each lid lift 248, 250 defines a channel 256 by which the lid may be lifted. The channel 256 of the pair of first lid lifts 248 and/or the pair of second lid lifts 250 are aligned and centrally positioned on the periphery of the top panel 244. The cargo container 210 may also have break-away pockets.

With reference to FIG. 9 showing the cargo container 210 in cross-section at section 9-9, the lid 214 further includes an inner panel 258 attached to a bottom face 260 of the top panel 244. The inner panel 258 includes a horizontally oriented upper flange 262, a first leg member 264, and a bottom wall 266. The upper flange 262 is attached to the bottom face 260 and is connected to the first leg member 264. The first leg member 264 extends vertically downward and away from the top panel 244 toward the bottom wall 266. The bottom wall 266 and the first leg member 264 are connected such that the top panel 244 and the bottom wall 266 are generally parallel and offset from each other. Together, the inner panel 258 attached to the top panel 244 further defines an air bladder 268 within the lid 214. More specifically, the inner panel 258 is bent to form the upper flange 262, the first leg member 264, and the bottom wall 266 of a single piece of material. It will be appreciated, however, that the inner panel 258 may also be assembled from multiple components and/or materials. The bladder may be considered an optional component according to various embodiments of this invention.

At least one of the panels 222 is a sidewall 270 shown in FIG. 9. The sidewall 270 includes an outer wall 272, a lip 274, a second leg member 276, and a lower flange 278. The outer wall 272 extends vertically along the cargo container 210 separating the interior storage space 232 from the outer environment 104. The lip 274 is connected to the outer wall 272 and extends horizontally inward to the vertically oriented second leg member 276. The second leg member 276 is connected to the lip 74 and to the lower flange 278, which is oriented horizontally. Moreover, the sidewall 270 is positioned relative to the lid 214 such that the upper and lower flanges 262, 278 are parallel and offset from each other, and the first and second leg members 264, 276 are parallel and offset from each other.

At the upper portion of the housing 216, the frame member 224 abuts the lip 274 and the second leg member 276 and is connected to both the lip 274 and the second leg member 276.

According to this embodiment, these connections to the frame member 224 are both welds. Thereby, the frame member 224 structurally stiffens the housing 212. Also, the frame member 224 provides a base 280 adequate for the bolted joint into which the plurality of capscrews 226 may be threaded to affix the lid 214 to the housing 212. Thus, the frame member 224 operably contains the hazardous material within the cargo container 210 in the event of an impact during transportation.

With respect to the containment of the hazardous materials of the cargo container 210, the lid 214 affixed to the housing 212 further defines a tortuous path 282 to prevent the escape of fluid, particles or other matter within the interior storage space 232 from communicating directly with and escaping to the outer environment 104. A first aspect of the tortuous path 282 is a groove 286. The groove 286 is defined by the first leg member 264 and the second leg member 276. From the groove 286, the first portion of the tortuous path 282 is further narrowed against a first gasket 288 and a second gasket 289. The gaskets 288, 289 are sandwiched between the upper flange 262 of the lid 214 and the lower flange 278 of the housing 212. Thereby, the gaskets 288, 289 are compressed to create a first seal 290 between the lid 214 and the housing 212. The gaskets 288, 289 are two offset gaskets which create additional offsets and higher friction between the gasket 288 to gasket 289 contacts (see FIG. 9). The gaskets 288, 289 are applied with pressure sensitive adhesive (PSA) and, as such, form a second seal 291 against the upper flange 262 and the lower flange 278, respectively. While the gaskets 288, 289 are used for sealing the lid 214 to the housing 212 in an exemplary seal arrangement, it will be appreciated that other structures for sealing the lid 214 to the housing 212 may be used in accordance with the invention described herein.

It is believed that the two gaskets 288, 289 are an advantage to the system working to contain hazardous materials. Additionally, another aspect of this invention is that the gaskets 288, 289 have the PSA backing, which ensures the seal to the metal, on both the lid 214 and the housing 212, while allowing the container to be reopened. A single gasket could not be adhered to the lid and to the box, as the container sometimes needs to be reopened. Moreover, it was determined that the air would slip by the non-glued side of the gasket, where it met the lid, when only one gasket was used. Furthermore, the increased friction between the two non-glued sides of the gaskets 288, 289 under compression adds another path, and a series of turns to slow the air.

A second aspect of the tortuous path 282 is that upon a potentially damaging impact, collision or fall of the cargo container 210, it is believed that inhibiting air borne hazardous materials within from escaping the cargo container 210 is enhanced if the flow or path of the materials is directed initially toward impingement on one of the outer walls 272, leg members 264, 276 or wall 266 of the lid 214 as opposed to direct impingement upon either of the gaskets 288, 289. In this manner, the velocity and force of the flowing hazardous material seeking to escape the cargo container 210 is significantly decreased prior to encountering the gaskets 288, 289. As such, the slower moving hazardous materials within the cargo container 210 are more effectively and completely contained by the seals 290, 291 and associated gaskets 288, 289. Moreover, it is believed that directing the flow of hazardous materials to reflect or bounce off of more than one surface, such as two or more of the outer walls 272, leg members 264, 276 or wall 266 of the lid 214, further minimizes and inhibits the escape of the hazardous materials. The housing 212 and mating lid 214 of this embodiment in conjunction with the seals and groove achieves this design objective.

The tortuous paths operatively contain the hazardous materials within the interior storage space 232 by initially deflecting the hazardous material away from the first and second seal 290, 291. For instance, under the influence of gravity, the hazardous materials may rest within the interior storage space 232. In the event that the cargo container 210 is struck or shaken, the hazardous materials may be projected toward the first seal 290. However, the bottom wall 266 and the groove 286 deflect the hazardous materials away from the first seal 290, which falls back to rest within the interior storage space 232. Thus, contact of the hazardous materials with the first gasket 288 is minimized to reduce the likelihood that the hazardous materials will communicate with the outer environment 104 by seeping through the first seal 290. Moreover, the second seal 291 further contains the hazardous materials because it becomes increasingly difficult for hazardous materials to pass through each of the first, second, and third portions of the tortuous path.

Figure 10:
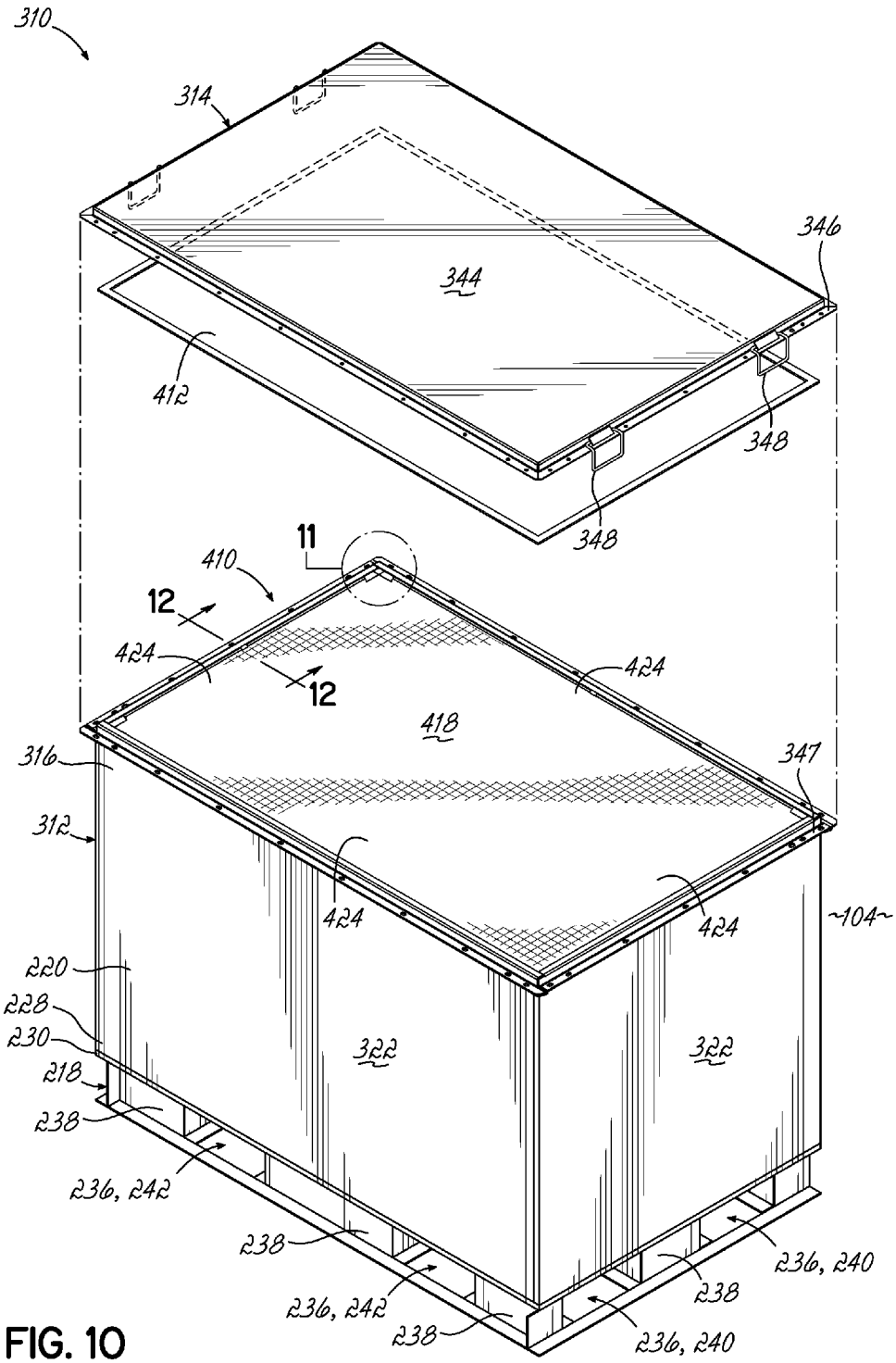
FIG. 10 is a partially disassembled perspective view of a third embodiment of a cargo container for transporting hazardous materials according to this invention.
Figure 11:
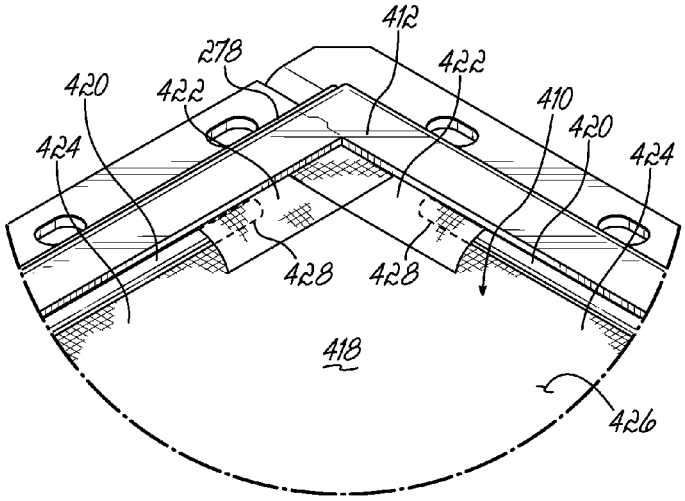
FIG. 11 is an enlarged view of area 11 of FIG. 10 showing a seal arrangement positioned within the cargo container.
Figure 12:
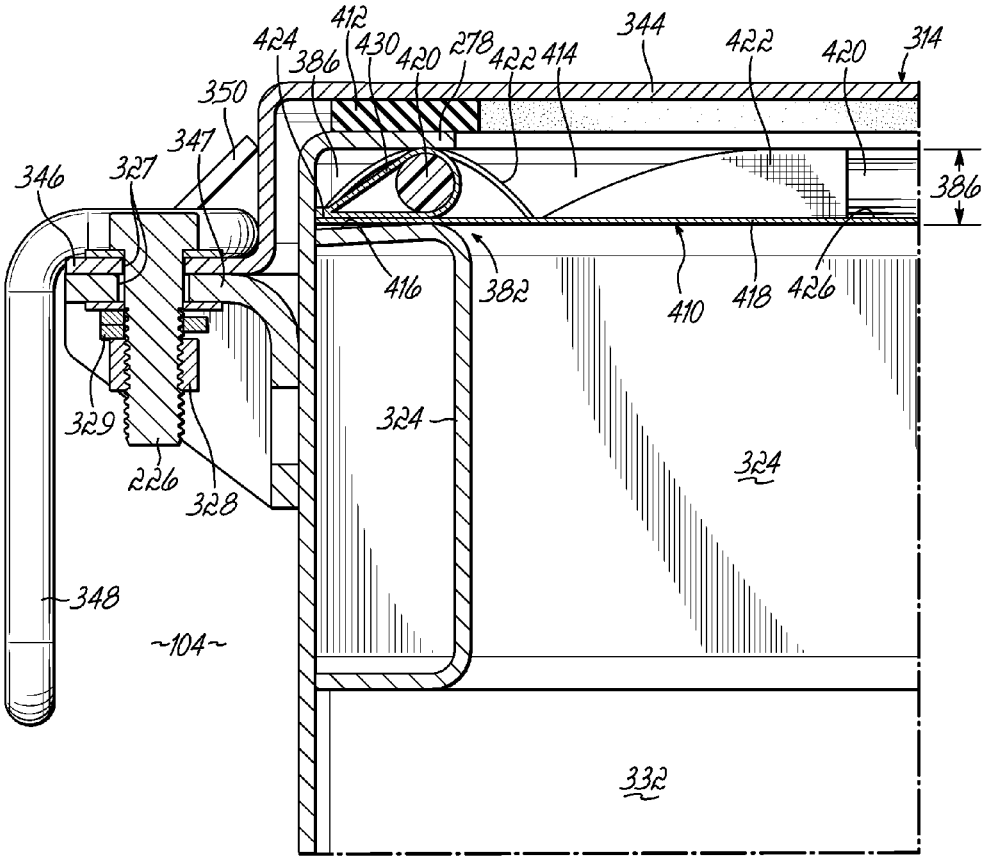
FIG. 12 is a cross-sectional view of FIG. 10 taken at section 12-12 to illustrate the seal arrangement of the third embodiment of the container, but showing the cargo container assembled.

A third embodiment of a cargo container 310 is shown in FIGS. 10-12 and includes a housing 312, a lid 314 affixed to an upper portion of the housing 316, and the lift support 218 connected to a lower portion of the housing 220. In this respect, the lower portion of the housing 220 is similar to the second embodiment of the cargo container 210 shown in FIG. 8. As such, like numbers indicate like features described above. The housing 312 includes a plurality of panels 322 defining vertical sidewalls of a rectangular cuboid. Each of the panels 322 includes the bottom portion 228 and the lower portion of the housing 220 is attached to the bottom panel 230. The bottom panel 230, the plurality of panels 322, and the lid 314 define the interior storage space 332. A seal arrangement 410 is positioned across the interior storage space 332 between the panels 322 for inhibiting air borne hazardous materials within the interior storage space 332 from escaping the cargo container 310.

The lid 314 is removably affixed to the housing 312 by the plurality of capscrews 226 for withstanding testing per the DOT Design Criteria. More particularly, the lid 314 includes a first guide flange 346 projecting from a top panel 344 toward a second guide flange 347 attached to the panels 322 at the upper portion of the housing 316. A plurality of holes 327 extend through each of the first and second guide flanges 346, 347 and align appropriately for receiving the plurality of capscrews 226 through the first guide flange 346 to the second guide flange 347. A nut 328 and a lockwasher 329 are threaded onto each of the capscrews 226 for securing the first and second guide flanges 346, 347 together for sealing the lid 314 against the housing 312. Of course, each nut 328, lockwasher 329, and capscrew 226 may be removed from the first and second guide flanges 346, 347 in order to unseal the lid 314 from the housing 312 and access the interior storage space 332 therein. Removal of the lid 314 is further facilitated by a plurality of handles 348 connected to the first guide flange 346 and positioned adjacent to opposing ends of the top panel 344. Each of the handles 348 pivotably connects to the first guide flange 346 by a capturing member 350 rigidly fixed against the first guide flange 346.

Furthermore, the top panel 344 of the lid 314 seals against the plurality of panels 322 via a gasket 412 positioned at an opening 414 into the interior storage space 332. The gasket 412 generally surrounds the opening 414 and is positioned on the lower flange 278, which projects inwardly from each of the panels 322 at the upper portion of the housing 316. Thus, when the lid 314 fastens to the second guide flange 347 as described above, the top panel 344 sandwiches the gasket 412 against the lower flange 278 for sealing the interior storage space 332 from the outer environment 104. As shown in FIGS. 11-12, the gasket 412 is secured to the lower flange 278 with PSA. As such, both the PSA and friction seal the gasket 412 when compressed by the lid 314, whereas the gasket 412 only seals to the lid 314 via friction. In the alternative, the gasket 412 may be secured to the lid 314 with PSA for sealing the gasket 412 against the lid 314 with both the PSA and friction. A further alternative may include a dual gasket as described above with respect to the second embodiment of the cargo container 210 (see FIG. 9). While the gasket 412 is used for sealing the lid 314 to the housing 312 in an exemplary seal arrangement, it will be appreciated that other structures for sealing the lid 314 to the housing 312 may be used in accordance with the invention described herein.

With respect to FIG. 12, the housing 312 further includes a groove 386 at least partially surrounding the plurality of panels 322 within the interior storage space 332 for suspending the seal arrangement 410 therein. A plurality of inner frame members 324 are attached to the plurality of panels 322 and generally surround the opening 414 within the interior storage space 332. More particularly, each of the inner frame members 324 is positioned below and extends along the lower flange 278. As such, the plurality of inner frame members 324 provide for at least dual purposes according to an exemplary embodiment. First, the plurality of inner frame members 324 further strengthen the cargo container 310 for providing additional rigidity to withstand testing per the DOT Design Criteria. Second, the inner frame member 324 includes a support surface 416. According to an exemplary embodiment, the support surface 416 and the lower flange 278 define the groove 386 that receives the seal arrangement 410 for supporting the seal arrangement 410 in order to cover the opening 414.

The gasket 412, the lid 314, the plurality of inner frame members 324, the lower flange 278, and the seal arrangement 410 within the groove 386 collectively define a tortuous path 382 from the interior storage space 332 to the outer environment 104. The seal arrangement 410 includes a sheet material 418 and two pairs of opposing extension members 420 for forming the sheet material 418 to cover the opening 414. In various embodiments, the sheet material for the seal arrangement 410 may be a tarp material as described above. Also, the sheet material 418 includes a pair of opposing pockets 422 along each edge portion 424 of the sheet material 418 for holding each extension member 420 adjacent to the edge. Each pocket 422 is defined by an additional layer of sheet material 418 secured to a top surface 426 of the sheet material 418.

In a disassembled state, the sheet material 418 is generally flexible and may be folded for easy storage. In an assembled state, an end portion 428 of each extension member 420 inserts into each pocket 422 in order to rigidly extend along each edge portion 424 of the sheet material 418. Once each edge portion is extended as shown in FIGS. 10-12, the sheet material 418 is held generally taut by the extension members 420 to extend across the opening 414 and into each groove 386 for suspension within the interior storage space 332. The seal arrangement 410 is removably inserted into the grooves 386 during transportation and may be removed for accessing the contents within the interior storage space 332. The extension members 420 are further held in position by a plurality of guides or straps 430 projecting from the end portion 428. Specifically, each guide or strap 430 captures the extension member 420 for inhibiting the extension member 420 from bending or moving out of the groove 386 as shown in FIG. 12. According to an exemplary embodiment, the extension members 420 are cylindrical, fiberglass poles; however, it will be appreciated that any structure for holding the sheet material 418 taut may be similarly used.

A first aspect of the tortuous path 382 is the groove 386 having the extension member 420 and edge portion 424 of the sheet material 418 positioned therein. A second aspect of the tortuous path 382 is that upon a potentially damaging impact, collision or fall of the cargo container 310, it is believed that inhibiting air borne hazardous materials within from escaping the cargo container 310 is enhanced if the flow or path of the materials is directed initially toward impingement on one of the panels 322, inner frame members 324, or the sheet material 418 as opposed to direct impingement upon the gasket 412. In this manner, the velocity and force of the flowing hazardous material seeking to escape the cargo container 310 is significantly decreased prior to encountering the gasket 412. As such, the slower moving hazardous materials within the cargo container 310 are more effectively and completely contained by the lid 314 and housing sealed by the gaskets 412. Moreover, it is believed that directing the flow of hazardous materials to reflect or bounce off of more than one surface, such as two or more of the one of the panels 322, inner frame members 324, or the sheet material 418, further minimizes and inhibits the escape of the hazardous materials. The housing 312 and mating lid 314 of this embodiment in conjunction with the seal arrangement 410 and groove 386 achieves this design objective.

While this invention has been illustrated by the description of one or more embodiments thereof, and while the embodiments have been described in considerable detail, they are not intended to restrict or in any way limit the scope of the appended claims to such detail. Additional advantages and modifications will readily appear to those skilled in the art. The invention in its broader aspects is therefore not limited to the specific details, representative apparatus and method and illustrative examples shown and described. Accordingly, departures may be from such details without departing from the scope or spirit of the general inventive concept.

What is claimed is:

1. A cargo container for transporting hazardous materials, comprising;

a housing connected to a frame, the frame and the housing defining an opening and an interior storage space, the interior storage space being accessible through the opening;

a lid operatively connected to the frame, the lid covering the opening for inhibiting access to the interior storage space through the opening;

a flange operatively connecting to the frame and positioned adjacent to the lid covering the opening, the flange generally surrounding the opening;

a first gasket positioned on the flange and generally surrounding the opening, the first gasket sandwiched between the flange and the lid for fluidly sealing the lid to the flange for inhibiting hazardous materials from moving from the interior storage space to an outer environment; and a tortuous path at least partially defined by the housing and extending from the interior storage space to the first gasket, and at least one aspect of the tortuous path being a groove generally surrounding the opening, wherein at least the housing is configured to deflect at least a portion of air borne hazardous materials away from the first gasket such that the tortuous path further inhibits passage of hazardous material from the interior storage space to the outer environment.

2. The cargo container of claim 1 wherein the groove is further defined by a portion of the lid.

3. The cargo container of claim 2 the lid includes an inner panel defining an air bladder such that the inner panel and air bladder further define the groove.

4. The cargo container of claim 1 wherein the first gasket is attached to the lid and further comprises:

a second gasket attached to the flange, the first and second gaskets sandwiched together and offset from each other for higher friction and contact between the gaskets.

5. The cargo container of claim 4 wherein the first and second gaskets are respectively attached to the lid and flange via pressure sensitive adhesive.

6. The cargo container of claim 1 further comprising:

a support surface generally surrounding the opening and positioned proximate to the flange such that the support surface further defines the groove.

7. The cargo container of claim 1 further comprising a seal arrangement positioned adjacent to the interior storage space and covering the opening for further deflection of air borne hazardous materials away from the first gasket.

8. The cargo container of claim 7 where at least a portion of the seal arrangement is positioned within the groove for supporting the seal arrangement across the opening.

9. The cargo container of claim 8 wherein the seal arrangement further comprises:

a sheet material having an edge portion; and an extension member connected to the edge portion of the sheet material and configured to rigidly extend the edge portion of sheet material, wherein the extension member removably inserts into the groove for supporting the seal arrangement across the opening.

10. The cargo container of claim 9 wherein the seal arrangement further comprises a plurality of pockets, the plurality of pockets receiving the extension member for holding the extension member therein.

11. The cargo container of claim 10 wherein the extension member is a fiberglass pole.

12. A cargo container for transporting hazardous materials, comprising;

a frame and a housing, the frame and the housing defining an interior volume, the interior volume being accessible through an opening;

a door connected to the frame and adjacent to the opening such that the door is movable between an open position and a closed position;

a locking mechanism connected to at least one of either the door or the frame, the locking mechanism interlockable to seal the door to the frame;

a seal arrangement being closable at an opening and positioned within the interior volume to define an interior storage volume, the interior storage volume being accessible via the closable opening;

a first seal being between the frame and the door and surrounding the entirety of the opening; and a second seal sealing the closable access opening of the seal arrangement, wherein the first seal sufficiently seals the interior to inhibit the escape of hazardous materials therethrough.

13. The cargo container of claim 12 wherein the seal arrangement includes a plurality of flaps at the opening, and the plurality of flaps configured to connect for sealing the seal arrangement closed.

14. The cargo container of claim 13 wherein at least a portion of the flaps connect via hook and loop fasteners.

15. The cargo container of claim 14 wherein at least another portion of the flaps further connect via a zipper.

16. A method of containing hazardous materials within a cargo container, the cargo container having a frame, a housing, and a door, the frame and the housing defining an interior volume, and the interior volume being accessible via the door through an opening, the method comprising;

creating a first seal between the door to the frame in a closed position in order to cover the opening and sufficiently seal the interior volume from an outer environment;

creating a second seal with a seal arrangement between the door and the interior storage space in order to further cover the opening; and deflecting airborne hazardous materials with the seal arrangement from the first seal for inhibiting passage of hazardous material from the interior volume to the outer environment;

wherein the seal arrangement is a tarp arrangement having a plurality of flaps, and creating the second seal further comprises:

overlapping the flaps; and sealing the flaps together via a plurality of hook and loop fasteners and a zipper.

17. A method of containing hazardous materials within a cargo container, the cargo container having a frame, a housing, and a lid, the frame and the housing defining an interior storage space, and the interior storage space being accessible through an opening, the method comprising;

sealing the lid to a flange via a gasket in order to cover the opening and sufficiently seal the interior storage space from an outer environment;

defining a tortuous path with at least the housing from the interior storage space to the gasket; and deflecting at least a portion of air borne hazardous materials away from the gasket with at least the housing such that the tortuous path further inhibits passage of hazardous material from the interior storage space to the outer environment;

wherein sealing the lid to the flange further comprises:

sandwiching the gasket against another gasket; and offsetting the gaskets for higher friction and contact therebetween for further inhibiting passage of hazardous material.

18. The method of claim 17 wherein deflecting at least a portion of airborne hazardous materials further comprises:

covering the opening with a seal arrangement between the lid and the interior storage space.

* * * * *